US005190309A

United States Patent [19]

Spitaler et al.

[11] Patent Number: 5,190,309

[45] Date of Patent: Mar. 2, 1993

[54] SKI BINDING FOR A CROSS COUNTRY SKI OR TOURING SKI

[75] Inventors: Engelbert Spitaler, Wr.Neudorf; Heinz Wittmann, Vienna; Roland Erdei, Weigelsdorf, all of Austria

[73] Assignee: HTM Sport-und Freizeitgeraete Gesellschaft m.b. H., Schwechat, Austria

[21] Appl. No.: 777,279

[22] PCT Filed: Mar. 14, 1991

[86] PCT No.: PCT/EP91/00484

§ 371 Date: Nov. 27, 1991

§ 102(e) Date: Nov. 27, 1991

[87] PCT Pub. No.: WO91/15275

PCT Pub. Date: Oct. 17, 1991

[30] Foreign Application Priority Data

Mar. 30, 1990 [AT] Austria ..... 745/90

[51] Int. Cl.[5] ..... A63C 9/00

[52] U.S. Cl. ..... 280/615

[58] Field of Search ..... 280/614, 615, 628, 611, 280/633, 634

[56] References Cited

U.S. PATENT DOCUMENTS 4,993,742 2/1991 Wittmann et al. ..... 280/615

5,044,655 9/1991 Garou ..... 280/615

*Primary Examiner*—Richard M. Camby

*Attorney, Agent, or Firm*—Flynn, Thiel, Boutell & Tanis

[57] ABSTRACT

A ski binding for a cross country or touring ski. The ski binding includes a swivel part (40) and a holding cup (50), both pivotal in unison about a transversely extending axle against the force of an elastic element and also with respect to one another. The swivel part (40) is a two-arm toggle lever and carries a locking pin on a first lever arm thereof and an axle for a lock part (60) on a second lever arm (43) thereof. The second lever arm (43) of the swivel part (40) extends downwardly and forwardly. The elastic element includes a spring (5) arranged in an elongated recess (33) in the base plate (31) of the bearing block (30) and directly stresses the second lever arm (43) of the swivel part (40).

4 Claims, 2 Drawing Sheets

SKI BINDING FOR A CROSS COUNTRY SKI OR TOURING SKI

FIELD OF THE INVENTION

The invention relates to a ski binding for a cross country ski or touring ski;

BACKGROUND OF THE INVENTION

Such a ski binding is described in the WO 87/03211 (corresponding to U.S. Pat. No. 4,993,742). The swivel part in this known ski binding is designed as a toggle lever and can, in the closed position of the binding, be swivelled together with the holding cup against the force of an elastic element. Such a cross country ski binding with the cross country ski boot fitting said binding is commercially available and has proven to be successful.

The elastic element is in this known cross country ski binding arranged in front of the swivel part and is supported on an upwardly directed arm of the swivel part. The elastic element itself is designed as a plastic block. This plastic block rests in the non-stressed position of the binding flat on the forwardly directed side of the swivel part. The swivel part together with the holding cup is swivelled upwardly during the walking movement, with the elastic element being compressed. The point of application of the respective restoring force changes during the swivelling caused by the swivelling movement and the change in form of the compressed elastic element. Furthermore, a problem results with the use of plastic springs in that the spring action is, among others, influenced by the outside temperature. Furthermore, plastic springs age relatively quickly under the influence of the weather and sun and must then be replaced.

A similar ski binding in EP-A2 0183000 suggests a use of a compression spring as the elastic element. However, this compression spring is also arranged in front of the swivel part and is supported on its forwardly directed side. Therefore, this known ski binding has also the problem of not exactly defining a point of application of the restoring force. Furthermore, the spring is subjected to weather and in particular to dirt and ice.

The purpose of the invention is to avoid the disadvantages of the known ski bindings and to design a ski binding of the above-mentioned type such that the restoring force of the spring is applied to a point selectable by the designer and also the spring characteristic can be designed selectively and is essentially independent of outside influences, like temperature, weather and dirt.

SUMMARY OF THE INVENTION

The objects and purposes of the invention have been met by providing a ski binding for a cross country or touring ski. The ski binding includes a swivel part and a holding cup both pivotal in unison about a transversely extending axle against the force of an elastic element and also with respect to one another. The swivel part is a two-arm toggle lever and carries a locking pin on a first lever arm thereof and an axle for a lock part on a second lever arm thereof. The second lever arm of the swivel part extends downwardly and forwardly. The elastic element includes a spring arranged in an elongated recess in the base plate of the bearing block and directly stresses the second lever arm of the swivel part.

The set goal is achieved according to the invention due to the fact that the second lever arm of the swivel part, viewed in the closed and not stressed position of the ski binding, extends directed downwardly and forwardly, it is possible to arrange the elastic element protected in the ski binding housing below the swivel element. This enables also the use of a metal spring which is applied to a point on the second lever arm of the swivel part, which point can be selected by the designer.

Another aspect of the invention is that the spring is supported at one end on a support surface of the second lever arm of the swivel part and at the other end on a rear boundary wall of the elongated recess and according to which the second lever arm carries a projection for the support and mounting of the spring. This is a particularly advantageous embodiment of the ski binding embodying the invention.

A still further aspect of the invention is a feature that enables the selective limitation of the swivel region of the unit of the holding cup, the swivel part and the lock part so as to prevent with certainty an excessive stress.

BRIEF DESCRIPTION OF THE DRAWINGS

Further advantages, characteristics and details of the invention will now be described in greater detail in connection with the drawings, in which.

DETAILED DESCRIPTION

Figure 1:
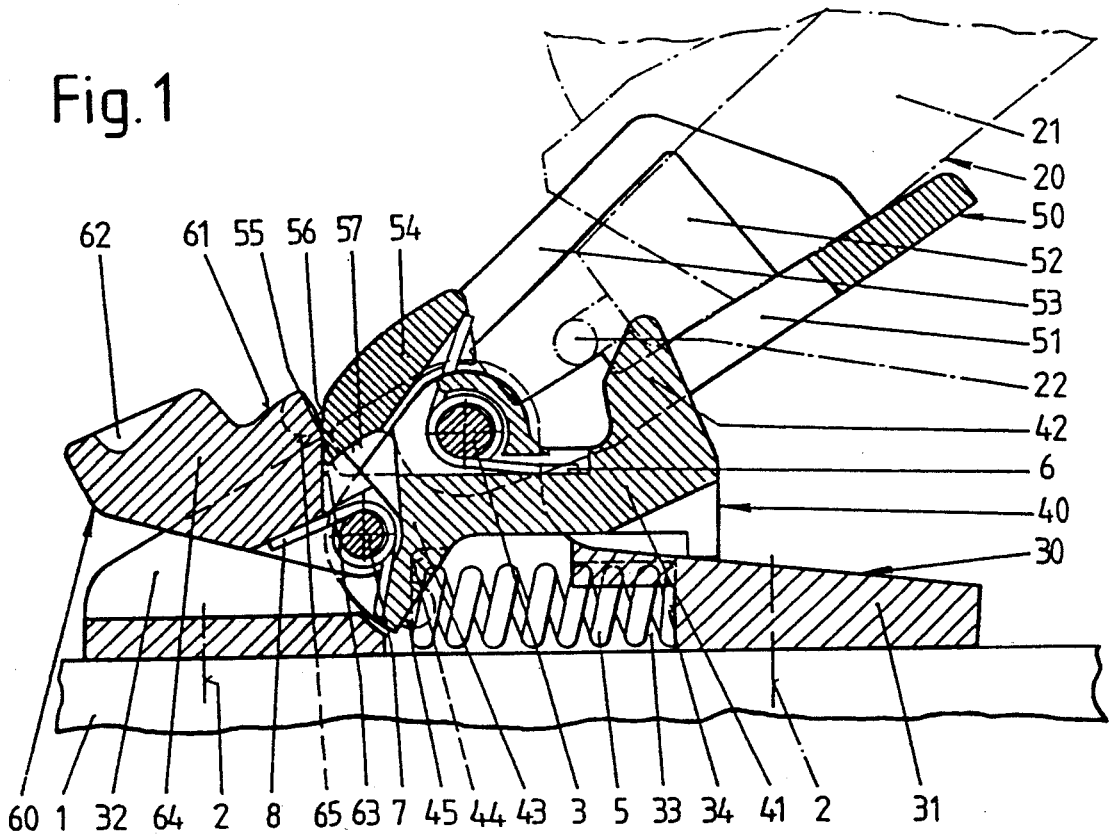
FIG. 1 is a longitudinal cross-sectional view of an embodiment of the cross country ski binding embodying the invention and in a position where it is ready to be stepped into.

The following description uses the terms front, rear, etc., which are to be considered from the standpoint of the user; namely front means directed toward the tip of the ski.

A bearing block 30 is mounted on the ski 1 by means of schematically indicated screws 2. It consists essentially of a base plate 31 and sidewalls 32. Recesses 35 are provided in the upper region of the sidewalls 32. The sidewalls 32 support a transversely extending axle 3. A swivel part 40 is hinged to the transversely extending axle 3. The swivel part 40 is designed as a toggle lever, with its first lever arm 41 extending rearwardly and carrying an upwardly directed locking pin 42, while the second lever arm 43 points inclined forwardly and downwardly. The second lever arm 43 has on its downwardly and rearwardly directed side a support surface 44 and a projection 45 for a spring 5, which is arranged in an elongated recess 33 of the base plate 31. The spring 5 is designed as a compression spring in this exemplary embodiment and is supported at one end thereof on the support surface 44 of the swivel part 40 and at the other end on a rear boundary wall 34 of the elongated recess 33.

The transversely extending axle 3 supports furthermore a holding cup 50 to receive a cross country ski boot 20. The holding cup 50 has an opening 51 for the locking pin 42. Guide rails 53 are provided at the top of the sidewalls 52 of the holding cup 50. The sidewalls 52 of the holding cup 40 are connected in their front part by a crossbar 54. The crossbar 54 is designed as a locking nose 55 at its front end, with its first surface 56 extending approximately in the form of a cylindrical sleeve section around the transversely extending axle 3. A second surface or holding surface 57 follows, which is also designed as a cylindrical sleeve section and which extends approximately in direction of the transversely extending axle 3.

An expanding spring 6 is arranged around the transversely extending axle 3 and continually urges the swivel part 40 and the holding cup 50 in opposite directions about the axle.

A locking axle 7 is arranged in the second lever arm 43 of the swivel part 40, which locking axle 7 extends transversely with respect to the longitudinal direction of the ski. The locking axle 7 carries a lock part 60 which has a locking region 61 and a recess 62 thereon. The recess 62 enables the tip of a ski pole to be inserted thereinto for the voluntary opening of the ski binding. The locking region 61 is a cylindrical sleeve surface, the axis of which coincides with the locking axle 7. An unobstructed surface portion 63 extends below the locking region 61. The lock part 60 has furthermore projections 65 on its sidewalls 64. The projections 65 are arranged slightly below the locking region 61. A locking spring 8 is arranged around the locking axle 7 to continually urge the lock part 60 in a closing direction.

FIG. 1 permits one to recognize that the front area of the cross country ski boot 20 has a sole 21 and a hook element 22 illustrated by dash-dotted lines in the drawings. This cross country ski boot 20 is known, it is not part of the subject matter of the invention and is, therefore, not described in detail.

Figure 2:
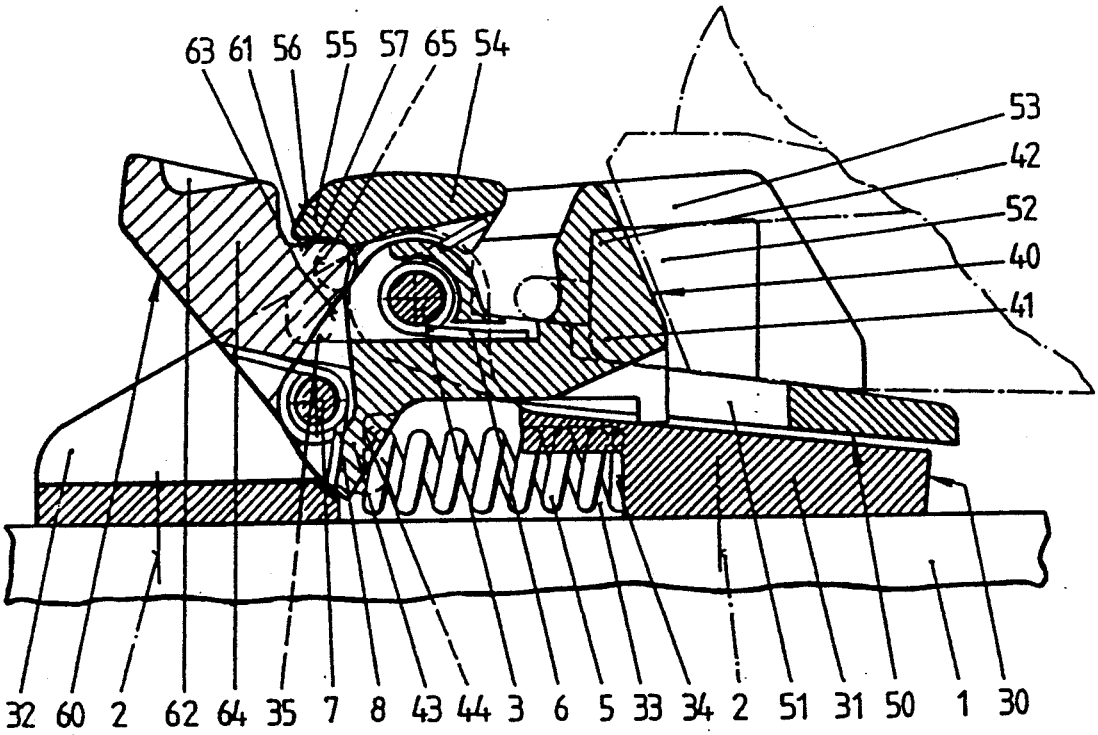
FIG. 2 illustrates the cross country ski binding of FIG. 1 in the closed, however, nonstressed position (sliding position)
Figure 3:
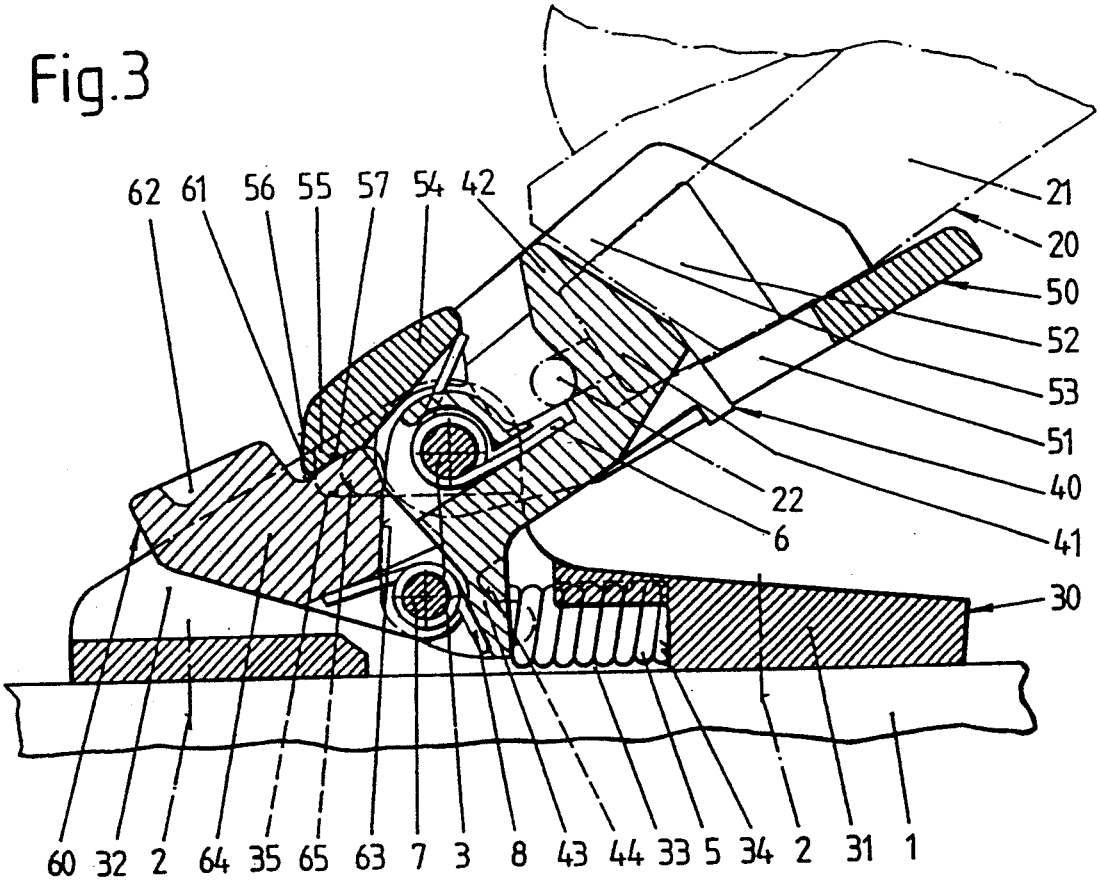
FIG. 3 illustrates the cross country ski binding in the walking position.

The cross country ski binding of the invention is ready to receive a ski boot 20 in FIG. 1 and is shown with an inserted cross country ski boot 20. The holding cup 50 is swung downwardly against the force of the expanding spring 6 when the cross country ski boot 20 is lowered, the locking pin 42 penetrating through the opening 51 of the holding cup 50 and extending into the opening existing between the sole 21 and the hook element 22. The first surface 56 of the locking nose 55 slides at the same time along the surface portion 63 of the lock part and thus permits the locking spring 8 to swing the lock part 60 into the closing direction until the locking region 61 of the lock part 60 engages the holding surface 57 of the holding cup 50. This position is shown in FIG. 2. Thus, the holding cup 50, the swivel part 40 and the lock part 60 form now one moving component with the cross country ski boot 20. During a walking movement (see FIG. 3), thus when the cross country ski boot 20 is lifted off from the ski 1, the holding cup 50, the swivel part 40 and the lock part 60 are pivoted as a unit about the transversely extending axle 3, with the spring 5 being compressed. The maximum swivelling movement is thereby limited in the present exemplary embodiment by the cooperation of the projections 65 with the recesses 35.

The invention is, of course, not to be limited to the described exemplary embodiment illustrated in the drawings. Rather modifications of the same exemplary embodiment illustrated in the drawings are possible without departing from the scope of the invention. Thus, it is, for example, conceivable to limit the swivelling movement of the unit formed of the cup, the swivel part and the boot by selecting a helical spring with a suitable spring force characteristic.

The embodiment of the invention in which an exclusive property or privilege is claimed are defined as follows:

1. A ski binding for a cross country ski or touring ski comprising a bearing block adapted to be secured to a ski, said bearing block having a base plate with an elongated recess therein and a horizontally transversely extending first axle thereon, a holding cup and a two-arm swivel part pivotally supported for movement about said horizontally transversely extending first axle in unison as well as with respect to one another for the purpose of transitioning between a closed and an open position of the ski binding, a first lever arm of said swivel part carrying at least one locking pin, said holding cup having means defining an opening for receiving therein said at least one locking pin in the closed position of the ski binding, said locking pin being fixed by a yieldable lock, and said holding cup being further adapted to grip over a front sole extension of a ski boot while said locking pin also extends through an opening in an extension of the front sole of the ski boot, whereas in the open position of the ski binding, said locking pin is removed from said opening on said holding cup, an elastic element for resisting said pivoting of said holding cup and said swivel part about said transversely extending first axle, a second lever arm of said swivel part having a second axle thereon extending parallel to said horizontally transversely extending first axle, said yieldable lock including a lock part pivotally mounted on said second axle for engaging said holding cup in the closed position of the ski binding, and a first spring for urging said holding cup and said swivel part apart, wherein said second lever arm of said swivel part, extends downwardly and forwardly, wherein said elastic element is a second spring arranged in said elongated recess in said base plate of said bearing block, and wherein said second lever arm of said swivel part is stressed directly by said second spring.

2. The ski binding according to claim 1, wherein said second spring is supported at one end on a support surface of said second lever arm of said swivel part and at an other end on a rear facing boundary wall of said elongated recess, and wherein a projection for centering the spring is arranged on said second lever arm.

3. The ski binding according o claim 1, wherein said bearing block additionally has laterally spaced sidewalls upstanding from said base plate, wherein said lock part has laterally outwardly facing projections on sidewalls thereof, and wherein recesses are provided in an upper region of said sidewalls of said bearing block, said recesses operatively receiving therein and cooperating with said projections to determine a range of pivoting of said holding cup relative to said bearing block.

4. The ski binding according to claim 1, wherein said second spring is a compression spring.

* * * * *